US006998981B1

(12) United States Patent
Montague

(10) Patent No.: US 6,998,981 B1
(45) Date of Patent: Feb. 14, 2006

(54) SECURE SCREEN

(76) Inventor: Marybeth W. Montague, 4615 N. 22nd St., #112, Phoenix, AZ (US) 85016

( * ) Notice: Subject to any disclaimer, the term of this patent is extended or adjusted under 35 U.S.C. 154(b) by 169 days.

(21) Appl. No.: 10/409,823

(22) Filed: Apr. 9, 2003

Related U.S. Application Data

(60) Provisional application No. 60/373,998, filed on Apr. 19, 2002.

(51) Int. Cl.
*G08B 21/00* (2006.01)

(52) U.S. Cl. ..... 340/540; 340/545.1; 340/550; 340/556; 160/10

(58) Field of Classification Search ..... 340/540, 340/545.1, 550, 556; 160/10

See application file for complete search history.

(56) References Cited

U.S. PATENT DOCUMENTS

| | | | | |
|---|---|---|---|---|
| 4,642,612 | A * | 2/1987 | Crump | 340/541 |
| 4,878,314 | A * | 11/1989 | Blockinger | 49/381 |
| 4,999,608 | A * | 3/1991 | Galomb | 340/550 |
| 5,056,262 | A * | 10/1991 | Schweiss et al. | 49/56 |
| 5,450,888 | A * | 9/1995 | Schwartzman et al. | 160/10 |

* cited by examiner

*Primary Examiner*—Daniel Wu
*Assistant Examiner*—Samuel J Walk

(57) ABSTRACT

A secure screen that includes a sheet of robust metal mesh having separate locking devices, located, but not limited to, the top, bottom, left, and right sides thereof that to provide for independent locking locations on the mesh member that are each lockable to one of four separate dwelling structure locations; a motion sensor being mechanically attached to an outer frame of the robust metal mesh member and, if connected to an existing alarm system, such that tampering with the electrically metal mesh member, can activate the alarm system to summon help and, thereby, prevent entry of a potential intruder.

5 Claims, 2 Drawing Sheets

SECURE SCREEN

This application claims benefit of Provisional Application Ser. No. 60/373,998 filed Apr. 19, 2002.

TECHNICAL FIELD

The present invention relates to building security devices and more particularly to a secure screen that is adapted for providing additional security to windows, screen glass doors, etc.; the secure screen including a sheet of robust metal mesh having a metal frame around the perimeter thereof and a number of separate locking devices; the separate locking device are located at a variety of locations including, but not limited to, top, bottom, left, and/or right sides of the frame; the separate locking devices each provide an independent locking location and are each lockable to a separate dwelling structure location; a motion sensor being mechanically attached to the outer frame of the robust metal mesh member and may be connected to an existing alarm system or the motion sensor may be independent of an existing alarm system, such that tampering with the metal mesh member will activate the alarm system.

BACKGROUND ART

It is often difficult for individuals who live in ground floor homes, apartments, condominiums, or other ground dwellings to feel safe because the glass windows, and sliding glass doors may be easily broken by an intruder to gain immediate access to the interior of the dwelling. It would be desirable, therefore, to have a secure screen made from a robust metal mesh to prevent a potential intruder from rapidly entering the dwelling while at the same time triggering an alarm so that the potential intruder never enters the dwelling and flees without stealing or injuring anyone.

General Summary Discussion of Invention

It is thus an object of the invention to provide a secure screen that includes a sheet of robust metal mesh having a metal frame around the perimeter thereof and having and having separate locking devices, including but not limited to, the top, bottom, left, and/or right sides thereof that to provide for independent locking locations on the mesh member that are each lockable to one to four separate dwelling structure locations; a motion sensor being mechanically attached to an outer frame of the robust metal mesh member which may or may not be connected to an existing alarm system such that tampering with the metal mesh member will activate the alarm system and if connected to an existing alarm system can summon help and, thereby, prevent entry of a potential intruder.

Accordingly, a secure screen is provided. The secure screen includes a sheet of robust metal mesh having a metal frame around the perimeter thereof and having and having separate locking devices, including but not limited to, the top, bottom, left, and/or right sides thereof that to provide for independent locking locations on the mesh member that are each lockable to one to four separate dwelling structure locations; a motion sensor being mechanically attached to an outer frame of the robust metal mesh member which may or may not be connected to an existing alarm system such that tampering with the metal mesh member will activate the alarm system and if connected to an existing alarm system can summon help and, thereby, prevent entry of a potential intruder.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

Exemplary Mode for Carrying Out the Invention

Figure 1:
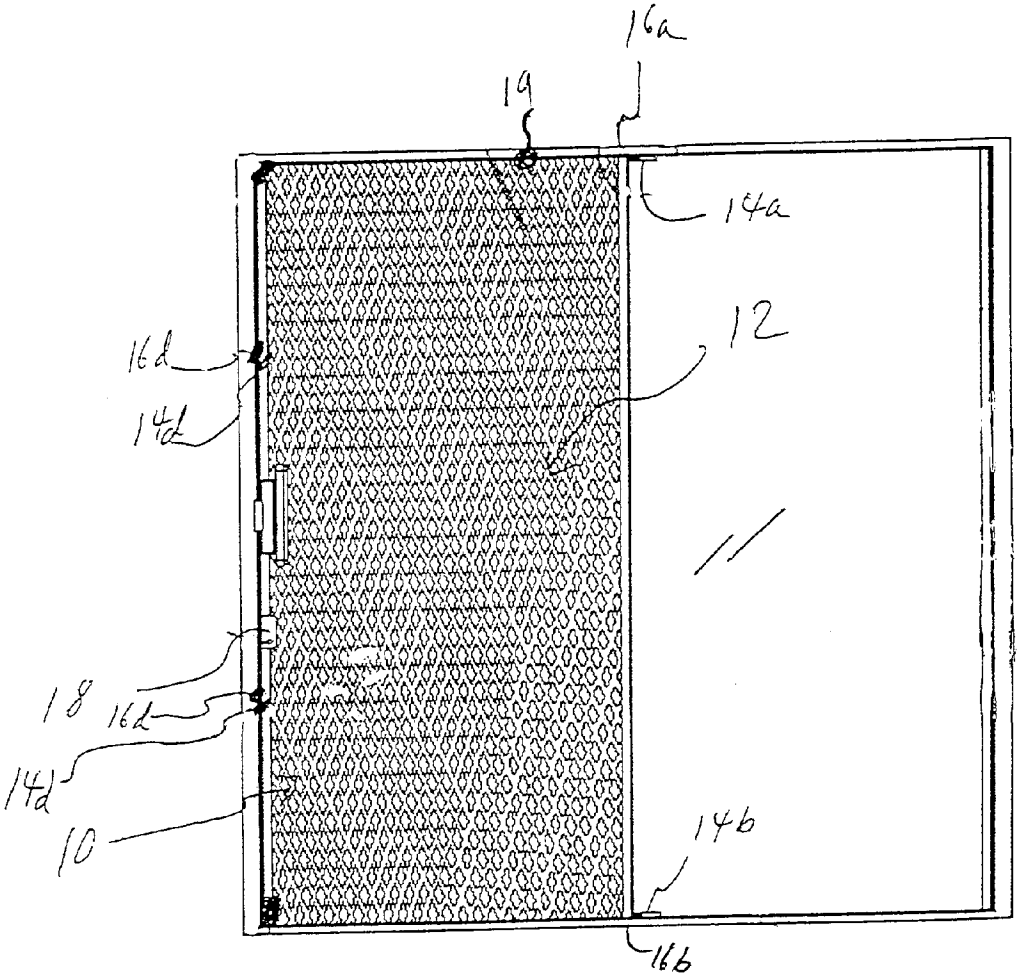
FIG. 1 is a plan view of an exemplary embodiment of the security screen of the present invention.
Figure 2:
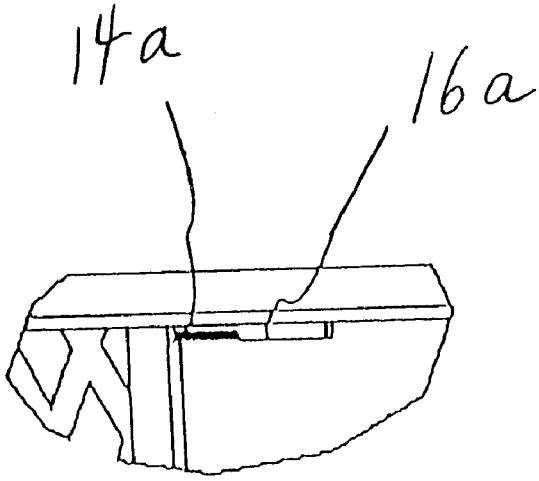
FIG. 2 is a detailed view showing one of the locks provided with the security screen of the present invention.

FIGS. 1–2 show various aspects of an exemplary embodiment of the secure screen of the present invention generally designated 10. Secure screen 10 includes a sheet of robust metal mesh, generally designated 12, having a metal outer frame 18 provided in connection with the perimeter of thereof robust metal mesh 12. Secure screen 10 also includes separate locking devices 14*a*, 16*a*; 14*b*, 16*b*; 14*c*, 16*c*; 14*d*, 16*d* that are positioned in locations that include but not are not limited to, the top, bottom, left, and/or right sides thereof that to provide for independent locking locations on the mesh member that are each lockable to one to four separate dwelling structure locations. A motion sensor 19 is mechanically attached to robust metal mesh member 12, and if connected to an existing alarm system such that tampering with the metal mesh member, can activate the alarm system to summon help and, thereby, prevent entry of a potential intruder.

It can be seen from the preceding description that a secure screen has been provided.

It is noted that the embodiment of the secure screen described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A secure screen for attachment to an opening in a dwelling structure, said secure screen comprising in combination:

a) a robust metal mesh having a perimeter;

b) a metal frame surrounding the perimeter of said mesh for supporting and for preventing relative movement between said metal frame and said mesh and said metal frame having a top, bottom, left and rights sides;

c) a plurality of locking devices mounted at different locations on said secure screen for lockingly engaging elements of the dwelling structure surrounding the opening;

d) each of said locking devices being disposed to one of said top, bottom, left and right sides of said metal frame; and e) a motion sensor attached to said metal frame for sounding an alarm upon any tampering with either of said metal mesh or said metal frame.

2. A secure screen as set forth in claim 1 wherein said motion sensor initiates a telephonic connection to a location to summon help.

3. A secure screen as set forth in claim 1 wherein each locking device of said plurality of locking devices is independently operated.

4. A secure screen as set forth in claim 3 wherein each locking device of said plurality of locking devices is in engagement with a different part of the dwelling structure.

5. A secure screen as set forth in claim 1 wherein said motion sensor includes an audible output.

* * * * *